US008773412B2

(12) United States Patent
Lee et al.

(10) Patent No.: US 8,773,412 B2
(45) Date of Patent: Jul. 8, 2014

(54) OVERDRIVE APPARATUS AND ASSOCIATED METHOD FOR DISPLAY SYSTEM

(75) Inventors: Wei-Kuo Lee, Hsinchu Hsien (TW); Hsin-Chun Chiang, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 234 days.

(21) Appl. No.: 13/104,341

(22) Filed: May 10, 2011

(65) Prior Publication Data

US 2011/0279421 A1 Nov. 17, 2011

Related U.S. Application Data

(60) Provisional application No. 61/333,728, filed on May 11, 2010.

(30) Foreign Application Priority Data

Apr. 1, 2011 (TW) ..... 100111663 A

(51) Int. Cl.
*G09G 5/00* (2006.01)

(52) U.S. Cl.
USPC ..... 345/204

(58) Field of Classification Search
CPC ..... G09G 2320/0252; G09G 3/3611; G09G 3/3674; G09G 5/06; G09G 5/395
USPC ..... 345/690, 204, 87, 212, 660, 102, 88
See application file for complete search history.

(56) References Cited

U.S. PATENT DOCUMENTS

| | | | | |
|---|---|---|---|---|
| 2007/0075951 | A1 | 4/2007 | Lin et al. | |
| 2008/0018571 | A1* | 1/2008 | Feng | 345/87 |
| 2010/0164982 | A1* | 7/2010 | Lu | 345/604 |
| 2011/0025680 | A1* | 2/2011 | Kim et al. | 345/214 |
| 2011/0063337 | A1* | 3/2011 | Lin et al. | 345/690 |
| 2011/0063545 | A1* | 3/2011 | Egi et al. | 349/96 |

FOREIGN PATENT DOCUMENTS

| | | | |
|---|---|---|---|
| CN | 101025509 | A | 8/2007 |
| TW | 201025280 | A1 | 7/2010 |

OTHER PUBLICATIONS

Taiwan Office Action dated Sep. 30, 2013, 12 pages.

* cited by examiner

*Primary Examiner* — Quan-Zhen Wang
*Assistant Examiner* — Tony Davis
(74) *Attorney, Agent, or Firm* — Edell, Shapiro & Finnan, LLC

(57) ABSTRACT

An overdrive apparatus applied to a display system is provided. The overdrive apparatus includes an indication unit, an access circuit and a plurality of memories. The indication unit provides an indication signal corresponding to a scan line of an image frame. The access unit reads a first overdrive table from a first memory among the memories, and loads a second overdrive table to a second memory among the memories according to the indication signal. The first overdrive table and the second overdrive table respectively correspond to a first region and a second region of the image frame.

13 Claims, 4 Drawing Sheets

OVERDRIVE APPARATUS AND ASSOCIATED METHOD FOR DISPLAY SYSTEM

This application claims the benefit of a provisional application Ser. No. 61/333,728, filed May 11, 2010, and Taiwan application Serial No. 100111663, filed Apr. 1, 2011, the subject matter of which are incorporated herein by reference.

BACKGROUND OF THE INVENTION

1. Field of the Invention

The invention relates in general to an overdrive apparatus and associated method applied to a display system, and more particularly to overdrive apparatus and associated method that provides different overdrive tables for different scan lines of an image frame through a simple memory arrangement.

2. Description of the Related Art

A display system, e.g., an LCD display system, is one of the most essential human-machine-interfaces (HMI) in modern electronic systems. It is therefore a research and development target for electronic manufacturers as to how to provide a display system with lower cost and higher performance.

A display system comprises several display units arranged as a plurality of scan lines. When displaying a frame of an image signal, display units on a same scan line respectively correspond to pixels of a same horizontal line in the frame. For example, each display unit displays different color levels of a primary color (e.g., red, green or blue) to indicate a component of the three primary colors.

Based in timing requirements of image display, the display system in sequence updates frames, e.g., updating an f frame to an (f+1) frame. To update a frame, the display system one after another updates the scan lines; that is, the display system updates a first scan line, and a second scan line after having updated the first scan line, and so on. When updating a scan line, a color level C(f), corresponding to one of the display units, of the f frame is updated to a color level C(f+1) of the (f+1) frame according to content of the image data. However, since a response time of the display unit is relatively slower in updating the color levels, it is often that the color level C(f) cannot be updated to C(f+1) in time.

To enhance the response time of the display unit, an overdrive technique is adopted in driving the display system. With overdriving, the display unit is driven to change the color level from C(f) to (C(f+1)+dC) instead of to C(f+1). For example, when the color level C(f+1) is greater than the color level C(f), the color level dC is predetermined to be greater than 0. Therefore, when the display unit is driven to the higher color level (C(f+1)+dC), the desired color level C(f+1) is more quickly achieved. Similarly, when the color level C(f+1) is smaller than the color level C(f), the color level dC is predetermined to be smaller than 0. Therefore, when the display unit is driven to the lower color level (C(f+1)+dC), the desired color level C(f+1) is more quickly achieved. In actual practice, the value of color level dC is obtained from an overdrive look-up table. For example, the overdrive table determines a positive/negative signal and values of the color level dC according to combinations of the color levels C(f) and C(f+1).

In many applications, timing requirements for updating different scan lines may vary. In certain applications, although the display system still updates the scan lines one after another when updating a frame, an updated frame is only displayed to viewers when all scan lines in the frame are updated. For example, in some three-dimensional applications, the display system alternately displays left frames and right frames with a display panel in conjunction with shutter glasses. When the display panel displays the left frames, the glasses open up for the left eye and shield the right eye to present the left frames to the left eye; when the display panel displays the right frames, the glasses at the same time open up for the right eye and shield the left eye to present the right frames to the right eye. Accordingly, the user perceives a three-dimensional image.

However, in the above three-dimensional application, the display system can only present a completely updated frame to the user (with opening and shutting of the glasses) to prevent undesirable effects caused by mixing the left and right frames. That is to say, timing requirements for updating different scan lines are different. When a last scan line of the frame is updated, the entire frame is updated and ready to be presented, and so the last scan line needs a relatively faster response time since it is given a smallest time period from being updated to being presented. In comparison, other scan lines have longer periods from being updated and to being presented and can thus be given with relatively slower response times. For example, a first scan line may have a slowest response time, a second scan line may have a second slowest response time, and so forth. Thus, a last scan line is allowed with a smallest time period and thus needs a fastest response time.

Therefore, to accommodate applications of different response times for different scan lines, the overdrive technique needs to provide different overdrive tables for the different scan lines.

SUMMARY OF THE INVENTION

The invention is directed to an overdrive apparatus and associated method that provides corresponding overdrive tables for a plurality of regions of an image frame by utilizing a simple, low cost, low power consumption, lower layout area and high performance hardware structure to accommodate different response speeds of different scan lines.

According to an aspect of the present invention, an overdrive apparatus applied to display system is provided for respectively providing corresponding overdrive tables to a plurality of regions in an image frame. The overdrive apparatus comprises an indication unit, a plurality of memories (e.g., DRAMs), and an access circuit. For example, each of the memories stores an overdrive table. The indication unit is for providing an indication signal corresponding to a scan line in the image frame. The access circuit reads a first overdrive table from a first memory and loads a second overdrive table to a second memory according to the indication signal. The first overdrive table and the second overdrive table respectively correspond to a first region and a second region among the regions.

In one embodiment, the access circuit further reads a fourth overdrive table from a third memory. A calculation circuit receives the first overdrive table and the fourth overdrive table read by the access circuit, and respectively provides a driving value corresponding to each of a plurality of display units in the first region.

According to another aspect of the present invention, an overdrive method applied to display system is provided for respectively providing corresponding overdrive tables to a plurality of regions in an image frame. The overdrive method comprises: providing an indication signal corresponding to a scan line in the image frame; and reading a first overdrive table from a first memory, and loading a second overdrive table to a second memory according to the indication signal. The first overdrive table and the second overdrive table respectively correspond to a first region and a second region among the regions.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
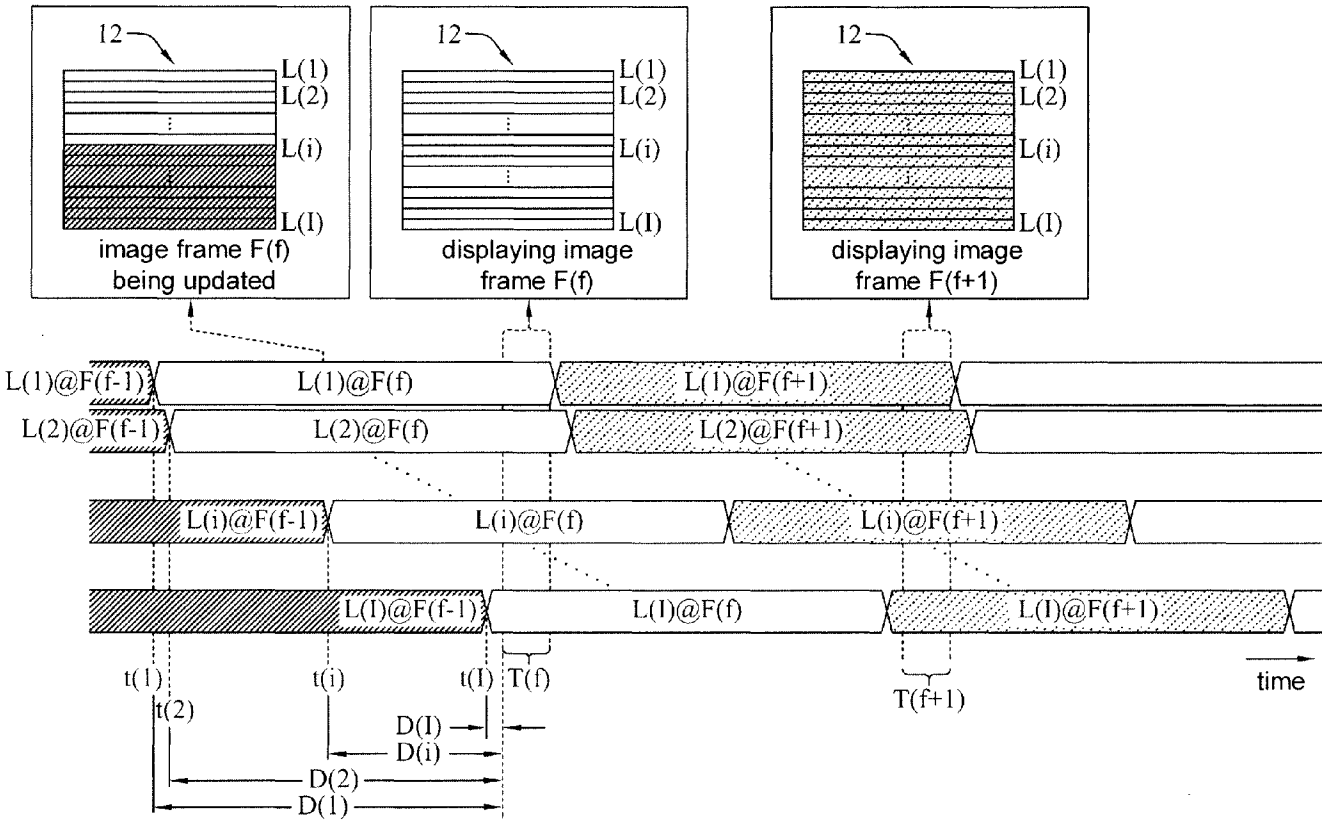
FIG. 1 is a schematic diagram of an application according to an embodiment of the present invention.

FIG. 1 shows a schematic diagram of an embodiment according to the present invention. Scan lines L(1), L(2) . . . , L(i) to L(I) are for presenting an image frame. When an image frame F(f−1) is to be updated to an image frame F(f), the scan lines are updated from the scan line L(1) to L(I) one after another. As shown in FIG. 1, the scan line L(1) with image data (indicated as (L(1)@F(f−1)) in FIG. 1) of the image frame F(f−1) is updated to image data (L(1)@F(f) of an image frame F(f) at a time point t(1). When the scan line L(1) is updated, the next scan line L(2) is updated at a time point t(2), and so forth. The scan line L(i) is only updated at a time point t(i), and the scan line L(I) is updated at an even later time point t(I).

As described previously, in many applications such as the three-dimensional display application, the complete image frame F(f) is only presented when all the scan lines L(1) to L(I) are updated, that is, the completely updated image frame F(f) is only presented at a time point T(f) after the time point t(I). Before any of the scan lines from L(1) to L(I) is yet to be updated, an incomplete image frame shall not be presented. For example, before the time point t(i), only scan lines L(1) to L(i−1) are updated to image data of the frame F(f), whereas the scan lines L(i) to L(I) still hold the image data of the previous image frame F(f−1), so that the incomplete image frame shall not be presented.

Since the scan lines are updated one after another, time differences from being update to being presented of the scan lines are different. For example, the scan line L(1) is updated at the time point t(1), and between the time point t(1) and a presented time T(f) is a time difference D(1); the scan line L(2) is updated at the time point t(2), and between the time point t(2) and the presented time T(f) is a time difference D(2); and so forth. For the scan line L(i), a time difference D(i) between the time point t(i) and the presented time T(f) is relatively shorter, and a time difference D(I) between the time point t(I) and the presented time T(f) is the shortest. Due to the different time differences, response times of the scan lines are thus different, meaning that overdrive of different degrees are needed for the different scan lines—the present invention is targeted at satisfying such requirement with a simple and high-performance memory arrangement.

Figure 2:
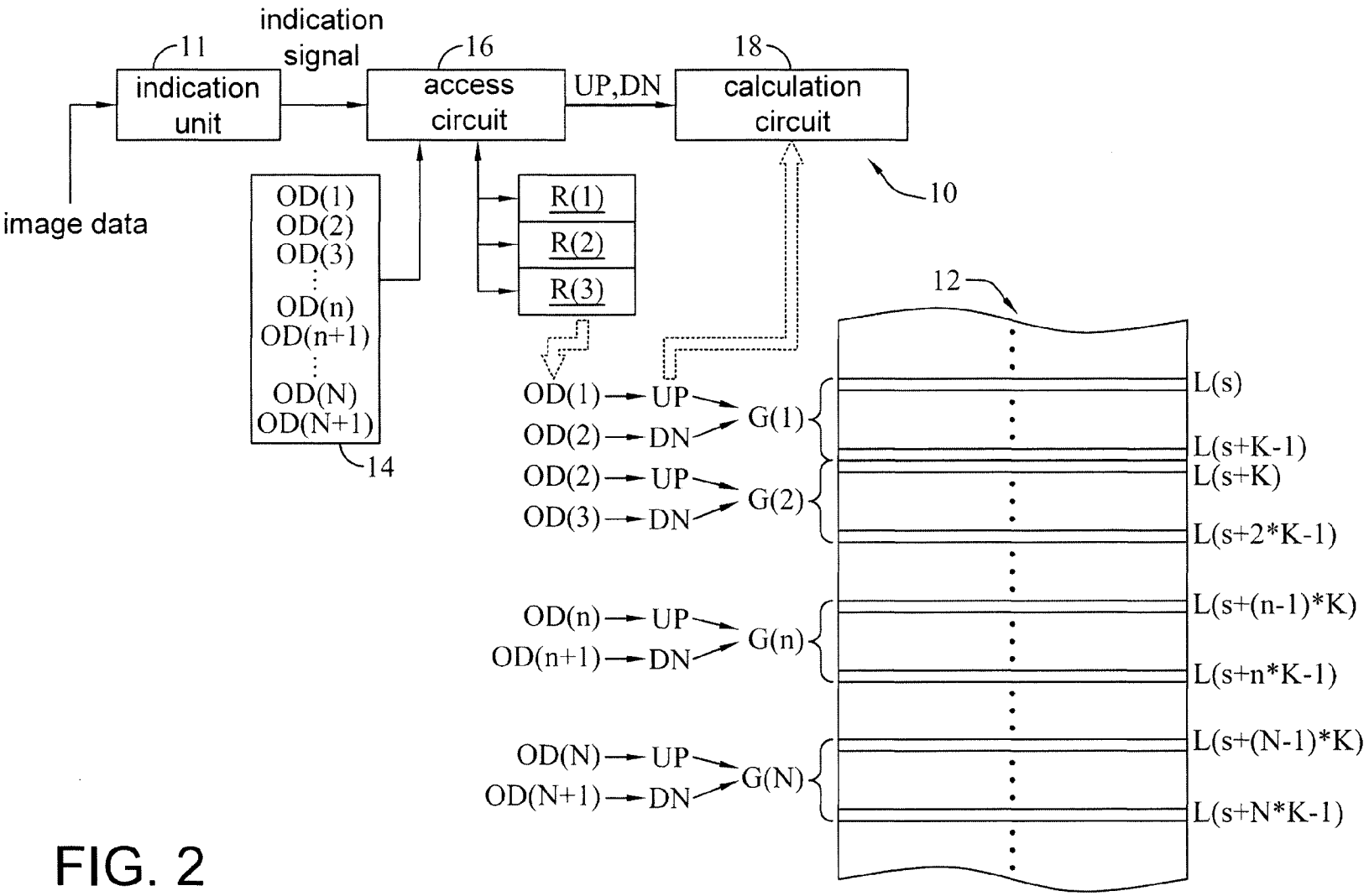
FIG. 2 is an overdrive apparatus according to an embodiment of the present invention.

FIG. 2 shows a schematic diagram of an overdrive apparatus 10 applied to a display system 12 according to an embodiment of the present invention. The display system 12 comprises a plurality of scan lines each comprising a plurality of display units (not shown) to form an image of a frame. From (s)th scan line L(s) to (s+N*K−1)th scan line, each K scan lines is regarded as a group to form a region. In one embodiment, K is a power of 2. For example, the scan lines L(s) to L(s+K−1) are a group G(1), a next K scan lines L(s+K) to L(s+2*K−1) are a next group G(2), and so forth. In an n group G(n) are scan lines L(s+(n−1)*K) to L(s+n*K−1), and a last N group G(N) is consisted of scan lines (s+(N−1)*K) to L(s+N*K−1). By changing values of K, the N groups of scan lines can be defined dynamically for different requirement.

In one embodiment, the overdrive apparatus 10 comprises an indication unit 11, a non-volatile memory 14, an access circuit 16, three volatile memories R(1) to R(3) (e.g., SRAM), and a calculation circuit 18. In practice, the three volatile memories R(1) to R(3) can be implemented by three different blocks in one volatile memory. The indication unit 11 generates a corresponding indication signal according to currently processed data of a scan line in an image frame by the overdrive apparatus 10. The access circuit 15 in sequence provides corresponding overdrive tables UP and DN for the scan lines in the groups G(1) to G(N) according to the indication signal. The calculation circuit 18 calculates corresponding driving values of the display units on the scan lines according to the indication signal and the overdrive tables UP and DN provided by the access circuit 16. As shown in FIG. 2, to update the scan lines in the group G(1), the access circuit 16 provides respectively overdrive tables OD(1) and OD(2) for interpolation calculation for the group G(1); to update the scan lines in the group G(2), the access circuit 16 provides respectively overdrive tables OD(2) and OD(3) for interpolation calculation for the group G(2); and so forth. More specifically, for the group G(n) (n being one number from 1 to N), according to the indication signal, the access circuit 16 respectively provides overdrive tables OD(n) and OD(n+1) as the overdrive tables UP and DN for interpolation calculation.

In one embodiment of the present invention, operations of the calculation circuit 18 are as described below. For a certain display unit on a scan line L(s+(n−1)*K+i) (where i is a number from 0 to (k−1)) in the group G(n), to update a color level C(f) of an f image frame to a color level C(f+1) of an (f+1) image frame, the calculation circuit 18 respectively locates two corresponding values dCup and dCdn from the overdrive tables UP and DN according to combinations of the color levels C(f) and C(f+1), and calculates a color level dC=a(i)*dCup+(1−a(i))*dCdn by interpolation calculation according to two interpolation weights a(i) and (1−a(i)), and a color level (C(f+1)+dC) then serves as a driving value of the display unit. More specifically, when overdriving the display unit for update, the display unit is driven towards the color level (C(f+1)+dC), so that a response speed of changing the color level matches an expected speed.

In the interpolation calculation of the calculation circuit 18 above, the interpolation weights a(i) ranges between 0 and 1 and is varied according to the subscript i; that is, different scan lines may correspond to different values of the interpolation weight a(i). In one embodiment, the subscript i is modified according to the indication signal. For example, the interpolation weight a(i) is increased or decreased according to the subscript i. That is, although the scan lines of a same group refer to the same overdrive tables UP and DN, the different scan lines are still allowed to be overdriven by different degrees with the effects of the interpolation weight. Further, when the access circuit 16 provides the overdrive tables UP and DN for different groups based on the overdrive tables OD(1) to OD(N+1), the overdrive tables OD(1) to OD(N+1) may nevertheless be different. More specifically, for two overdrive tables OD(n1) and OD(n2) (where n1 differs from n2), predetermined color levels C(f) and C(f+1) are present so that the predetermined color levels C(f) and C(f+1) may correspond to different values in two overdrive tables. Since the overdrive tables OD(1) to OD(N+1) are different, the different groups G(1) to G(N) also correspond to different overdrive degrees. By combining changes of the different overdrive tables OD(1) to OD(N+1) and the interpolation weight a(i), overdrive values of different degrees are thus respectively rendered to the scan lines L(s) to L(s+N*K−1). On the other hand, a same overdrive table (e.g., the overdrive table OD(1)) may be shared by the scan lines before the scan line L(s), and another overdrive table OD(N+1) may be shared by the scan lines after the scan lines L(s+N*K−1).

The overdrive tables OD(1) to OD(N+1) can be stored in the non-volatile memory 14. Upon activating the overdrive apparatus 10 for respectively updating the driving values for the scan lines L(s) to L(s+N*K−1) one after another according to image timings, the overdrive tables UP and DN corresponding to the scan lines are loaded to a volatile and fast-accessible memory, so that the calculation circuit 18 is allowed to immediately look up the tables and perform calculations with efficiency. For example, the memories R(1) to R(3) are respectively for temporarily storing one of the overdrive tables OD(1) to OD(N+1). It is to be noted that, although a total number of the overdrive tables OD(1) to OD(N+1) may be far greater than 3 (i.e., N is greater than 2), only three memories R(1) to R(3) are implemented in the embodiment shown in FIG. 2 of the present invention to quickly and efficiently provide overdrive tables needed for update in a seamless manner.

Figure 3:
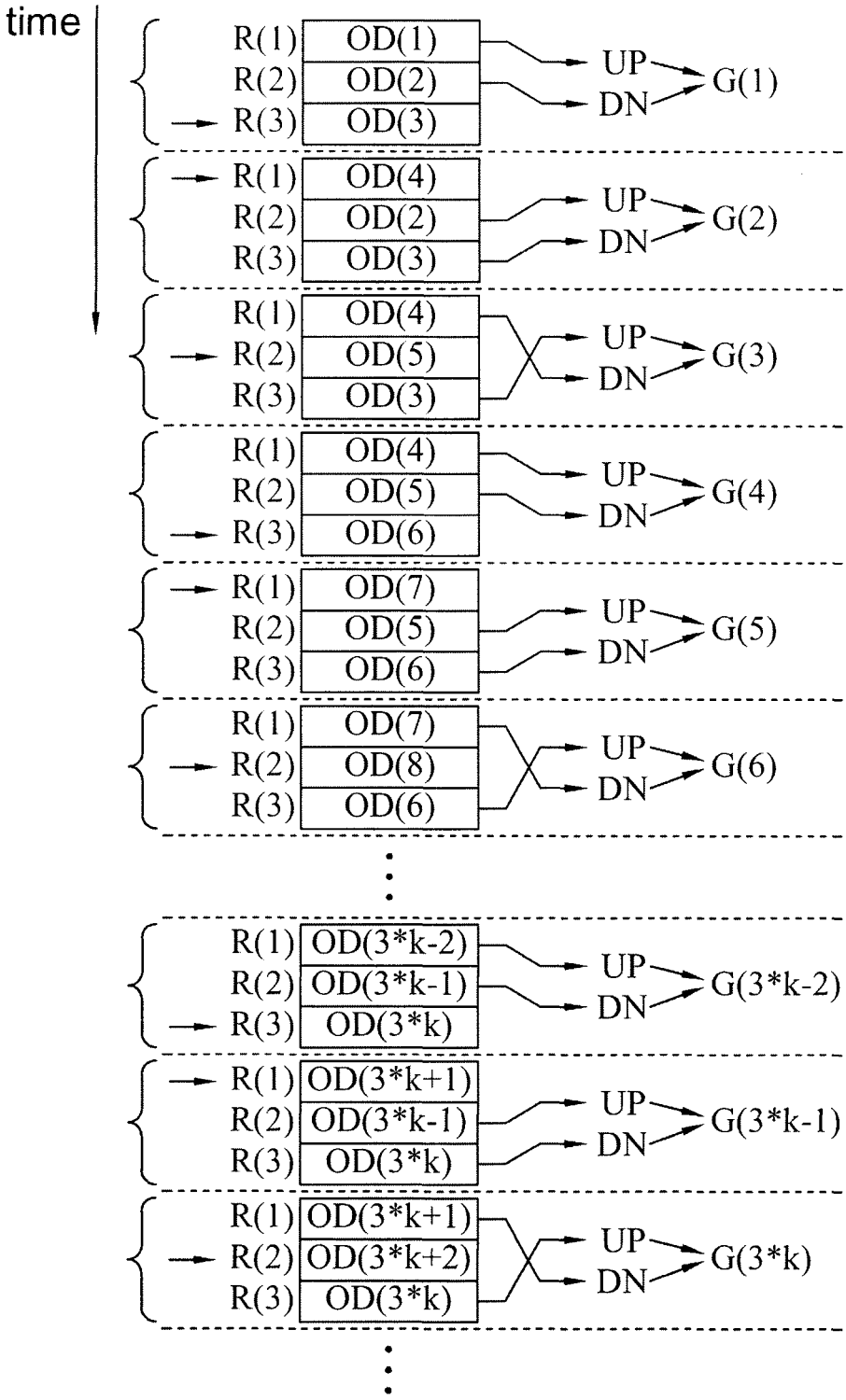
FIG. 3 is a schematic diagram illustrating operations of the overdrive apparatus in FIG. 2

In continuation of the embodiment shown in FIG. 2, operations of the overdrive apparatus 10 of the present invention that provides overdrive tables for the groups of scan lines by implementing the memories R1 to R3 are as illustrated in FIG. 3. When the indication signal corresponds to the scan lines in the group G(1), the overdrive tables OD(1) to OD(3) are first respectively loaded to the memories R(1) to R(3) from the non-volatile memory 14. To update the scan lines in the group G(1), the access circuit 16 respectively reads from the memories R(1) and R(2) the overdrive tables OD(1) and OD(2) as the overdrive tables UP and DN of the group G(1). The calculation circuit 18 then calculates the driving values of the display units on the scan lines of the group G(1) according to the indication signal and the overdrive tables UP and DN.

When the scan lines of the group G(1) are one after another updated to next update the scan lines of the group G(2), the indication signal in sequence corresponds to the scan lines of the group G(2), and the access circuit 16 respectively reads from the memories R(2) and R(3) the overdrive tables OD(2) and OD(3) as the overdrive tables UP and DN of the group G(2), and simultaneously pre-loads the overdrive table OD(4) to the memory R(1). The calculation circuit 18 then calculates the driving values of the display units on the scan lines of the group G(2) according to the indication signal and the overdrive tables UP and DN.

When the indication signal changes to correspond to the scan lines of the group G(3), since the overdrive table OD(4) is loaded to the memory R(1), the access circuit 16 is able to directly read from the memories R(3) and R(1) the overdrive tables OD(3) and OD(4), respectively, as the overdrive tables UP and DN needed by the group G(3), so that the calculation circuit 18 can calculate the driving values of the display units on the scan lines of the group G(3) according to the indication signal and the overdrive tables UP and DN. Meanwhile, the access circuit 16 also pre-loads the overdrive table OD(5) needed by the group G(4) to the memory R(2).

Similarly, when the indication signal indicates that the group G(4) is to be updated, the access circuit 16 respectively reads from the memories R(1) and R(2) the overdrive tables OD(4) and OD(5) as the overdrive tables UP and DN, and pre-loads the overdrive table OD(6) needed by the group G(5) to the memory R(3). The calculation circuit 18 then calculates the driving values of the display units on the scan lines of the group G(4) according to the indication signal and the overdrive tables UP and DN.

More specifically, according to the indication signal that indicates which scan lines are to be updated, when updating the group G(n), the access circuit 16 respectively reads from the two memories among the memories R(1) to R(3) the overdrive tables OD(n) and OD(n+1) to support as the overdrive tables UP and DN needed by the group G(n), and pre-loads the overdrive table OD(n+2) (i.e., the overdrive table DN of the group G(n+1)) needed by the next group G(n+1) to another memory originally storing the overdrive table OD(n−1). Therefore, when updating the next group G(n+1), the needed overdrive tables UP and DN are respectively readily available in the memories R(1) to R(3) for immediate access, so that the update of the scan lines can be seamlessly proceeded and no time is wasted for loading the overdrive table OD(n+1) from the non-volatile memory 14 to the memory.

Again referring to FIG. 3, supposing the subscript n of the group G(n) is written as (3*k−2) (i.e., mod(n, 3)=1, where n=1 or 4, for example), the corresponding overdrive tables UP and DN (i.e., the overdrive tables OD(3*k−2) and OD(3*k−1)) are respectively pre-loaded to the memories R(1) and R(2). When the access circuit 16 reads the two memories R(1) and R(2) to support operations of the calculation circuit 18, the access circuit 16 also loads the overdrive table OD(3*k) from the non-volatile memory 14 to the memory R(3).

Similarly, supposing the subscript n of the group G(n) is written as (3*k−1) (i.e., mod(n, 3)=2, where n=2 or 5, for example), the corresponding overdrive tables UP and DN (i.e., the overdrive tables OD(3*k−1) and OD(3*k)) are respectively pre-loaded to the memories R(2) and R(3). When the access circuit 16 reads the two memories R(2) and R(3) to support operations of the calculation circuit 18, the access circuit 16 also loads the overdrive table OD(3*k+1) from the non-volatile memory 14 to the memory R(1).

Similarly, supposing the subscript n of the group G(n) is written as (3*k) (i.e., mod(n, 3)=0), the corresponding overdrive tables UP and DN (i.e., the overdrive tables OD(3*k) and OD(3*k+1)) are respectively pre-loaded to the memories R(3) and R(1). When the access circuit 16 reads the two memories R(3) and R(1) to support operations of the calculation circuit 18, the access circuit 16 also loads the overdrive table OD(3*k+2) from the non-volatile memory 14 to the memory R(2).

Figure 4:
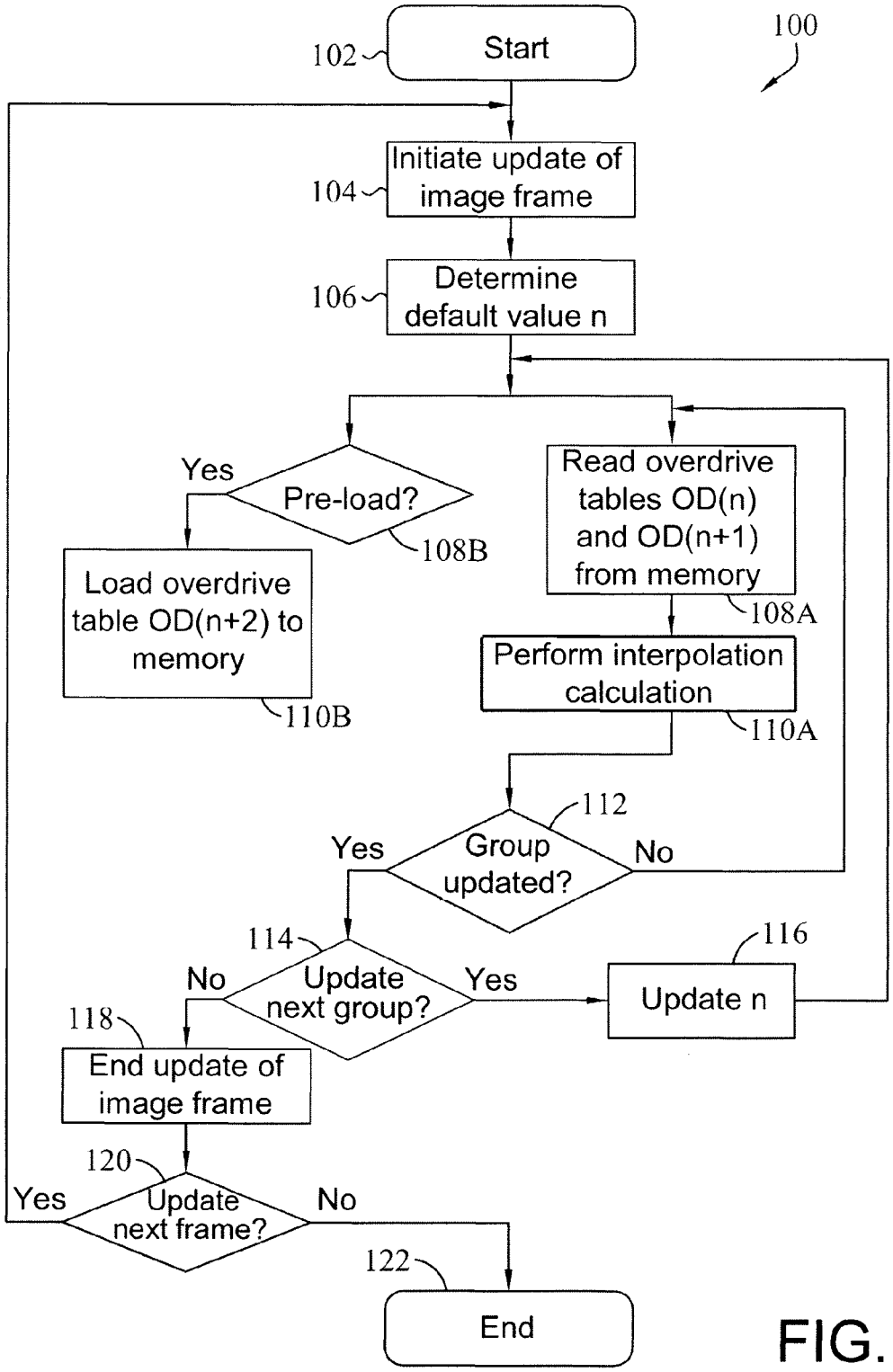
FIG. 4 is a flowchart illustrating operations of the overdrive apparatus in FIG. 2.

FIG. 4 shows a flowchart of a flow 100 for operating the overdrive apparatus 10 in FIG. 2 according to an embodiment of the present invention. The flow 100 comprises steps below.

The flow 100 begins with Step 102, in which the overdrive apparatus 10 starts controlling display of the display system 12.

In Step 104, updating of an image frame based on image data is initiated, and the indication unit 11 generates corresponding indication signal according to data of a predetermined scan line of a currently processed image frame, so that indication signal corresponds to the predetermined scan line of the image frame. As described with reference to FIG. 2, within in same image frame, the scan lines L(s) to L(s+N*K−1) are updated on basis of groups, and so the scan lines (i.e., the scan lines L(1) to L(s−1), not shown) before the scan line L(s) are first updated.

In Step 106, overdriving and updating of the scan lines are performed on basis of groups. A default value of the subscript n is determined, and the scan lines of the group G(n) are updated according to the indication signal.

In Step 108A, for the group G(n), the access circuit 16 reads from the memory R(mod(n−1,3)+1) the overdrive table OD(n) as the overdrive table UP provided for interpolation calculation to the calculation circuit 18, and reads from the memory R(mod(n,3)+1) the overdrive table OD(n+1) as another overdrive table provided for interpolation calculation.

In Step 110A, for a predetermined scan line L(s+(n−1)*K+i) of the group G(n), the calculation circuit 18 looks up corresponding values in the overdrive tables UP and DN by utilizing the access circuit 16, and performs interpolation calculation according to the interpolation weight a(i), so as to calculate the driving values corresponding to the display units on the scan line.

In Step 108B, it is determined whether the overdrive table OD(n+2) for the next group G(n+1) needs to be pre-loaded, and the flow 100 proceeds to Step 110B if the pre-loading is required.

In Step 110B, when Step 110A is performed, the access circuit 16 simultaneously loads the overdrive table OD(n+2) to the R(mod(n+1,3)+1).

In Step 112, it is determined whether all the scan lines L(s+(n−1)*K) to L(s+n*K−1) of the group G(n) are updated. Steps 108A and 108B are iterated when there are still scan lines to be updated in the group G(n), so that the calculation circuit 18 again checks up values from the overdrive tables through the access circuit 16 and performs interpolation calculation to provide the driving value of another scan line. Else, Step 114 is performed when all the display units of all the scan lines in the group G(n) are overdriven and updated.

In Step 114, it is determined whether there are other groups of scan lines to be updated. Step 116 is performed when a determination result is affirmative, or Step 118 is performed when all the scan lines of all the groups G(1) to G(N) are overdriven and updated.

In Step 116, the value of the subscript is updated to indicate another group to be processed.

In Step 118, update of the image frame is ended. Since the groups G(1) to G(N) covers the scan lines L(s) to L(s+N*K−1), driving values of other scan lines (i.e., scan lines after the scan line L(s+N*K−1)) within a same image frame can be calculated and updated until all scan lines of a same image frame are updated.

In Step 120, Step 104 is iterated if update of another image frame is desired, or else Step 122 is performed to end the flow 100.

Compared to the prior art, the present invention is capable of seamlessly providing overdrive of different degrees for different scan lines by utilizing a simple hardware memory arrangement, so that from hardware cost, power consumption to layout area are effectively reduced while also enhancing overall performance. The overdrive apparatus of the present invention is applicable to a control/driving chip of a display panel, and functions of the calculation circuit 18 can be realized by software, hardware or firmware.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An overdrive apparatus, for respectively providing overdrive tables corresponding to a plurality of regions of an image frame, the apparatus comprising:

an indication unit, for providing an indication signal corresponding to a scan line of the image frame;

a first memory;

a second memory;

an access circuit, for reading a first overdrive table from the first memory and loading a second overdrive table to the second memory according to the indication signal, wherein the first overdrive table and the second overdrive table respectively correspond to a first region and a second region among the regions;

a third memory, wherein the access circuit reads the first overdrive table from the first memory, reads a fourth overdrive table from the third memory, and loads the second overdrive table to the second memory according to the indication signal; and a calculation circuit, for receiving the first overdrive table and the fourth overdrive table read by the access circuit, and accordingly providing a corresponding driving value to each of a plurality of display units of the first region;

wherein the calculation circuit determines an interpolation weight according to the indication signal, and provides the corresponding driving value by performing interpolation calculation according to the interpolation weight, the first overdrive table and the fourth overdrive table read, wherein the interpolation weight is a value between 0 and 1.

2. The apparatus according to claim 1, wherein the first memory and the second memory are volatile memories, the apparatus further comprising:

a non-volatile memory, for storing the first overdrive table and the second overdrive table;

wherein, the access circuit loads the second overdrive table from the non-volatile memory to the second memory.

3. The apparatus according to claim 1, wherein when the indication signal changes to correspond to another scan line, the access circuit changes to read the second overdrive table from the second memory and to load a third overdrive table to the first memory.

4. The apparatus according to claim 1, wherein the image frame is included in a three-dimensional image signal.

5. The apparatus according to claim 1, wherein each of the regions comprises a plurality of horizontal scan lines.

6. An overdrive method, for respectively providing overdrive tables corresponding to a plurality of regions in an image frame, the method comprising:

providing an indication signal corresponding to a scan line of the image frame;

reading a first overdrive table from a first memory and loading a second overdrive table to a second memory according to the indication signal, the first overdrive table and the second overdrive table respectively corresponding to a first region and a second region among the regions, wherein the step of reading the first overdrive table from the first memory according to the indication signal further comprises reading a fourth overdrive table from a third memory; and performing interpolation calculation according to the first overdrive table and the fourth overdrive table to respectively provide a driving value corresponding to each of a plurality of display units of the first region, wherein the interpolation calculation generates an interpolation weight having a value between 0 and 1.

7. The method according to claim 6, wherein when the indication signal changes to correspond to another scan line of the image frame, the method further comprising:

changing to read the second overdrive table from the second memory, and to load a third overdrive table to the first memory.

8. The method according to claim 6, further comprising:

determining an interpolation weight according to the indication signal, the interpolation weight being applied to the interpolation calculation.

9. The method according to claim 6, wherein the first memory and the second memory are volatile memories, the method further comprising:

storing the first overdrive table and the second overdrive table to a non-volatile memory;

wherein, the second overdrive table is loaded to the second memory from the non-volatile memory.

10. The method according to claim 6, wherein the image frame is included in a three-dimensional image signal.

11. The method according to claim 6, wherein each of the regions comprises a plurality of horizontal scan lines.

12. An overdrive apparatus, for respectively providing overdrive tables corresponding to a plurality of regions of an image frame, the apparatus comprising:

an indication unit, for providing an indication signal corresponding to a scan line of the image frame; and an access circuit, for reading a first overdrive table from a first memory and loading a second overdrive table to a second memory according to the indication signal;

wherein the first overdrive table and the second overdrive table respectively correspond to a first region and a second region among the regions, wherein the access circuit further reads a third overdrive table from a third memory, and the apparatus further comprises:

a calculation circuit, for respectively providing a driving value corresponding to each of a plurality of display units of the first region according to the first overdrive table and the third overdrive table, wherein the calculation circuit determines an interpolation weight according to the indication signal, and accordingly performs an interpolation calculation to provide the driving values, wherein the interpolation weight is a value between 0 and 1.

13. The apparatus according to claim 12, wherein the regions are defined dynamically.

* * * * *